US006351948B1

(12) United States Patent
Goeddeke

(10) Patent No.: US 6,351,948 B1
(45) Date of Patent: Mar. 5, 2002

(54) GAS TURBINE ENGINE FUEL INJECTOR

(75) Inventor: Mark G. Goeddeke, West Olive, MI (US)

(73) Assignee: Woodward FST, Inc., Zeeland, MI (US)

( * ) Notice: Subject to any disclaimer, the term of this patent is extended or adjusted under 35 U.S.C. 154(b) by 0 days.

(21) Appl. No.: 09/452,799

(22) Filed: Dec. 2, 1999

(51) Int. Cl.[7] ..... F02C 1/00; F02G 3/00
(52) U.S. Cl. ..... 60/740
(58) Field of Search ..... 60/740, 742, 746, 60/39.463; 123/198 D, 468, 469

(56) References Cited

U.S. PATENT DOCUMENTS 3,159,971 A * 12/1964 Moebius et al. ..... 60/39.74
3,817,505 A * 6/1974 LeRoy et al. ..... 266/41
4,258,544 A * 3/1981 Gebhart et al. ..... 60/39.02
4,735,044 A * 4/1988 Richey et al. ..... 60/742
5,423,178 A * 6/1995 Mains ..... 60/39.06
5,568,721 A * 10/1996 Alary et al. ..... 60/39.03
5,570,580 A * 11/1996 Mains ..... 60/747
5,577,386 A * 11/1996 Alary et al. ..... 60/742
6,076,356 A * 6/2000 Pelletier ..... 60/740

* cited by examiner

*Primary Examiner*—Charles G. Freay
*Assistant Examiner*—William Rodriguez

(57) ABSTRACT

A fuel injector for a gas turbine engine includes an elongated primary fuel tube residing within an elongated secondary fuel tube. The primary fuel tube is brazed or otherwise metallurgically joined to the injector housing proximate opposite end regions of the primary fuel tube. Between the end regions, the primary fuel tube includes a spiral configuration or profile that engages the inner wall of the secondary fuel tube in line-to-line interference contact along a sufficient portion of the lengths of the primary and secondary fuel tubes effective to reduce thermal and vibration stresses on the primary fuel tube and essentially eliminate fatigue failure at the brazed end regions and to increase its axial compliance, thereby lowering internal stresses imparted by a given thermal strain caused by rigid attachment of the relatively cool primary tube to the relatively hot support housing.

10 Claims, 6 Drawing Sheets

GAS TURBINE ENGINE FUEL INJECTOR

FIELD OF THE INVENTION

The present invention relates to gas turbine engine fuel injectors and, in particular, fuel injectors for the combustor of a gas turbine engine.

BACKGROUND OF THE INVENTION

Pressure atomizing fuel injectors for supplying primary fuel and secondary fuel to the combustor of a gas turbine engine are in use. These pressure atomizing injectors typically include a primary fuel tube to provide a relatively low fuel flow rate to a primary fuel discharge orifice of the injector during all regimes of engine operation. The primary fuel tube usually is disposed within a secondary fuel tube that provides a variable, metered secondary fuel flow to a secondary fuel discharge orifice as needed during high power engine operation regimes. During high power engine operation, the secondary fuel flows through the secondary fuel tube about the primary fuel tube to maintain the latter relatively cooler compared to the former.

A particular pressure atomizing fuel injector assembles the primary fuel tube and secondary fuel tube in the injector housing by metallurgical braze or weld joints near opposite ends thereof. During high power engine operation, the fuel injector undergoes thermal expansion and vibration resonance which generate internal stresses, especially on the relatively cooler primary fuel tube, found to cause premature fatigue failure (cracking) of one or more of the brazed joints proximate the opposite ends of the primary fuel tube. Fatigue failure of the braze joints of the primary fuel tube can lead to primary fuel internal leakage and requires costly repair or overhaul of the affected fuel injector.

An object of the present invention is to provide a fuel injector for a gas turbine engine having a fuel tube configured and assembled in an injector housing in a manner to reduce fatigue failure at metallurgical joints positioning the fuel tube in the injector housing and along the length of the fuel tube.

SUMMARY OF THE INVENTION

The present invention provides in one embodiment a fuel injector for a gas turbine engine wherein an elongated fuel tube is positioned in an internal passage in a fuel injector housing using metallurgical joints and is provided with a spiral configuration along at least a portion of its length between the joints for engaging an adjacent surface in the housing in line-to-line interference engagement at one or more locations in a manner that reduces fatigue failure (cracking) of the metallurgical joints during service in a gas turbine engine.

In a particular illustrative embodiment of the present invention, a fuel injector includes an elongated primary fuel tube residing within a an elongated secondary fuel tube. The primary fuel tube is positioned by brazed or other metallurgical joints proximate opposite end regions of the primary fuel tube. Between the brazed end regions, the primary fuel tube includes a generally helical spiral configuration or profile that engages the inner wall of the secondary fuel tube in line-to-line interference contact along a sufficient portion of the lengths of the primary and secondary fuel tubes effective to substantially reduce fatigue failure at the brazed joints during engine service. In another illustrative embodiment, the outer secondary fuel tube can include the generally helical spiral configuration, while the primary fuel tube is straight. The spiral of the secondary fuel tube can engage the outer surface of the primary fuel tube and/or the inner surface of a passage in the strut portion of the fuel injector.

The present invention can be practiced with pressure atomizing fuel injectors, airblast fuel injectors, and hybrid airblast-pressure atomizing fuel injectors to this end to reduce fatigue failure of a fuel tube therein.

DESCRIPTION OF THE DRAWINGS

FIG. 1A is an enlarged cross-sectional view of the metering valve region of the fuel injector of FIG. 1, while

DESCRIPTION OF THE INVENTION

Figure 1:
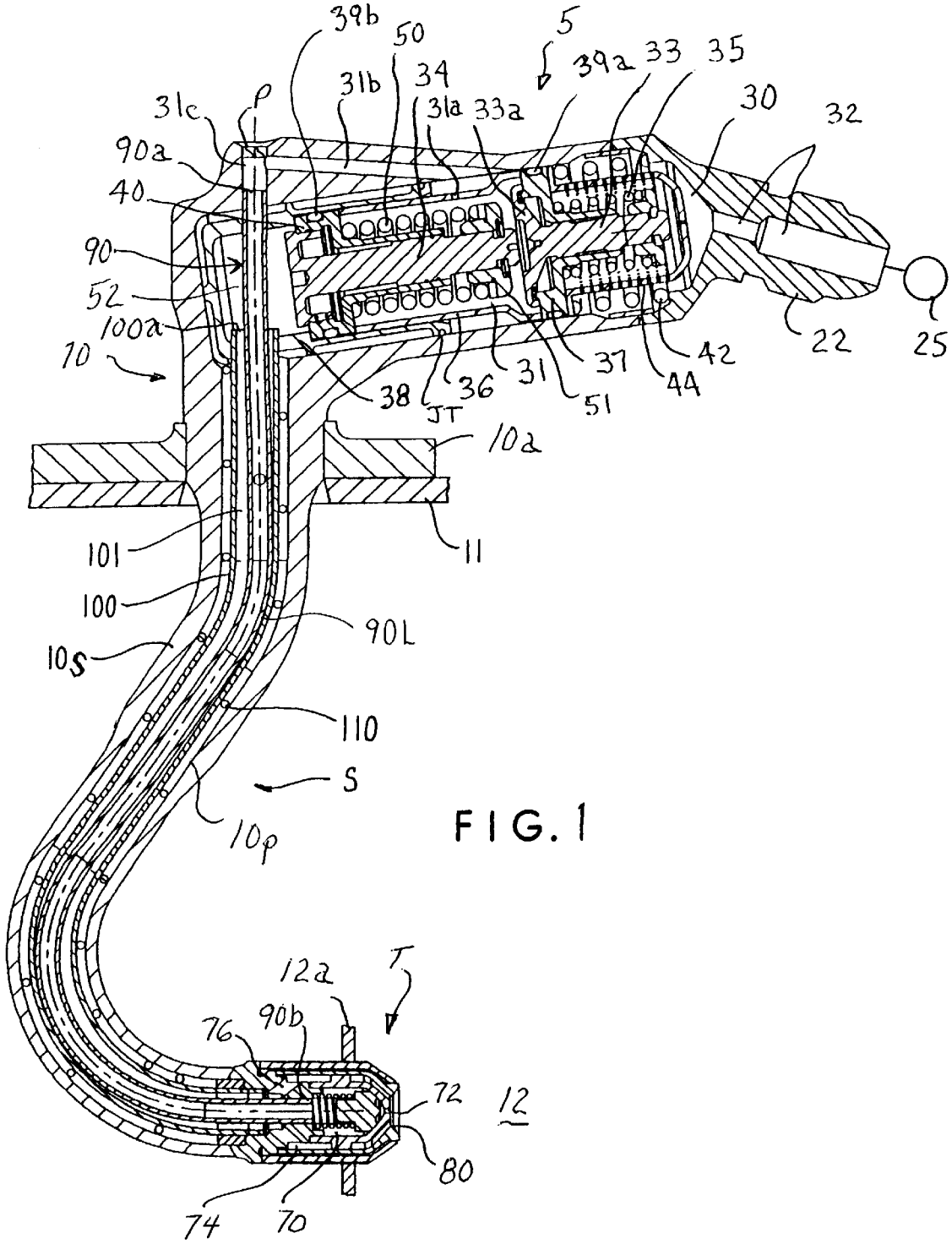
FIG. 1 is a cross-sectional view of a pressure atomizing fuel injector pursuant to an illustrative embodiment of the present invention.
Figure 2:
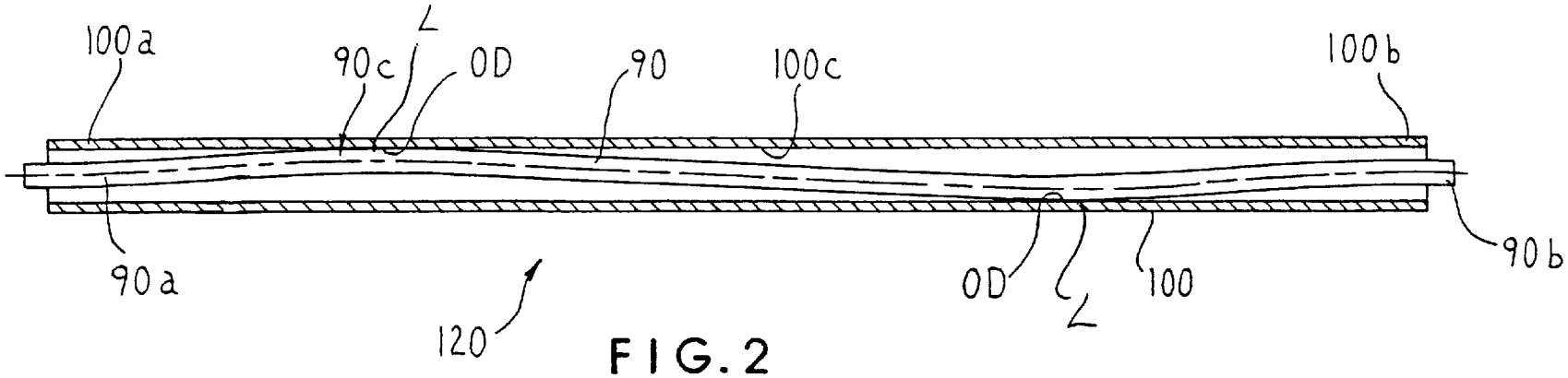
FIG. 2 is a sectional view of a straight secondary fuel tube having a spiraled primary fuel tube disposed therein prior to assembly in the fuel injector housing.

Referring to FIGS. 1–2, a pressure atomizing fuel injector 5 in accordance an embodiment of the present invention is shown. The fuel injector includes a tubular injector housing 10 having a flange 10*a* fastened thereto and adapted to be fastened (e.g. bolted) to an engine housing 11 (shown schematically) in conventional manner and an injector tip T fastened to the injector housing 10 and disposed in an opening in a gas turbine engine combustor wall 12*a* (partially shown) in conventional manner. The fuel injector 5 shown employs pressure of the fuel to effect atomization of the fuel into the combustor 12 as is known, although the present invention can be practiced with airblast fuel injectors and hybrid airblast-pressure atomizing fuel injectors which are well known for gas turbine engine combustor fuel injection systems.

Figure 1A:
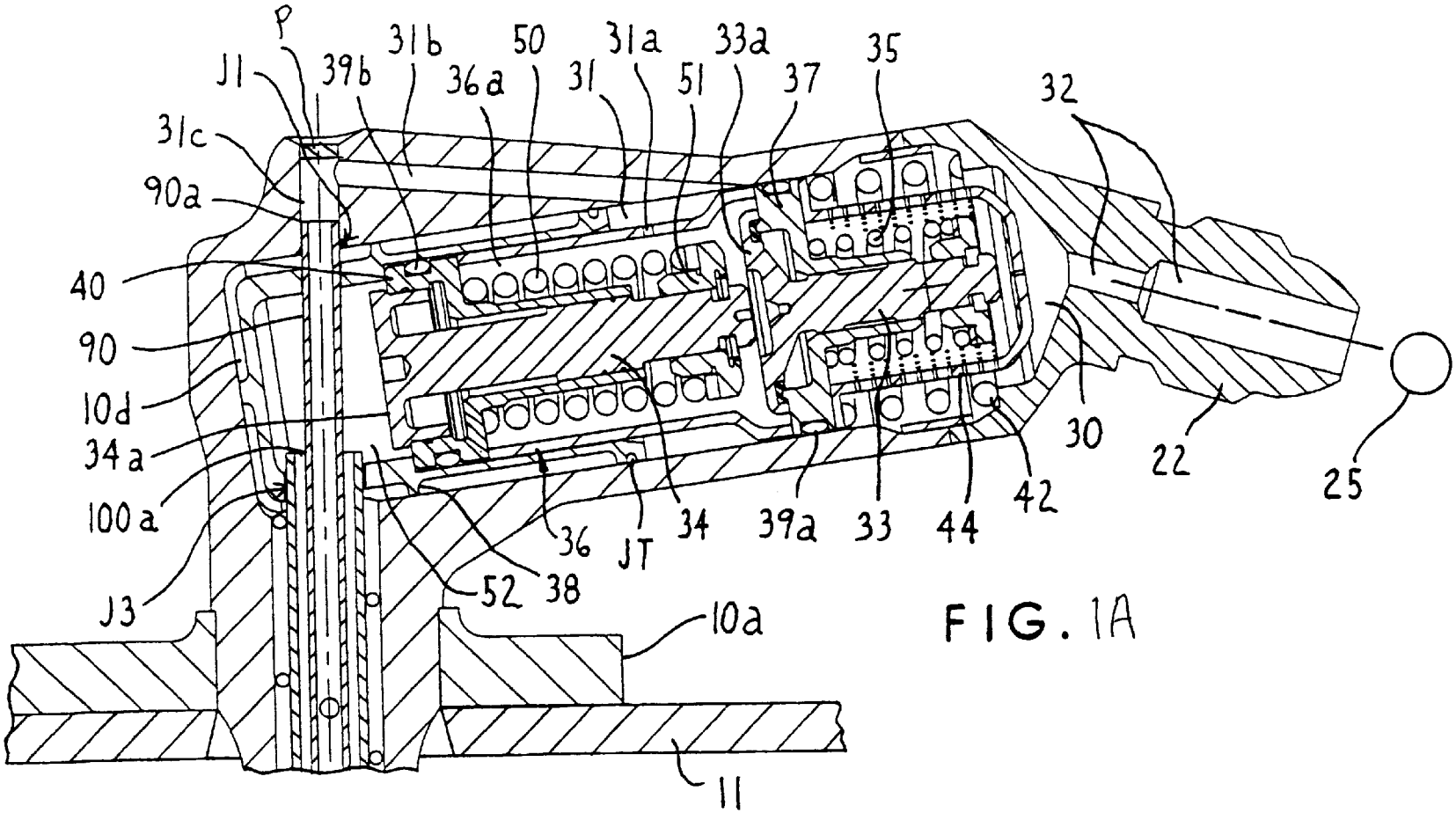
Figure 1B:
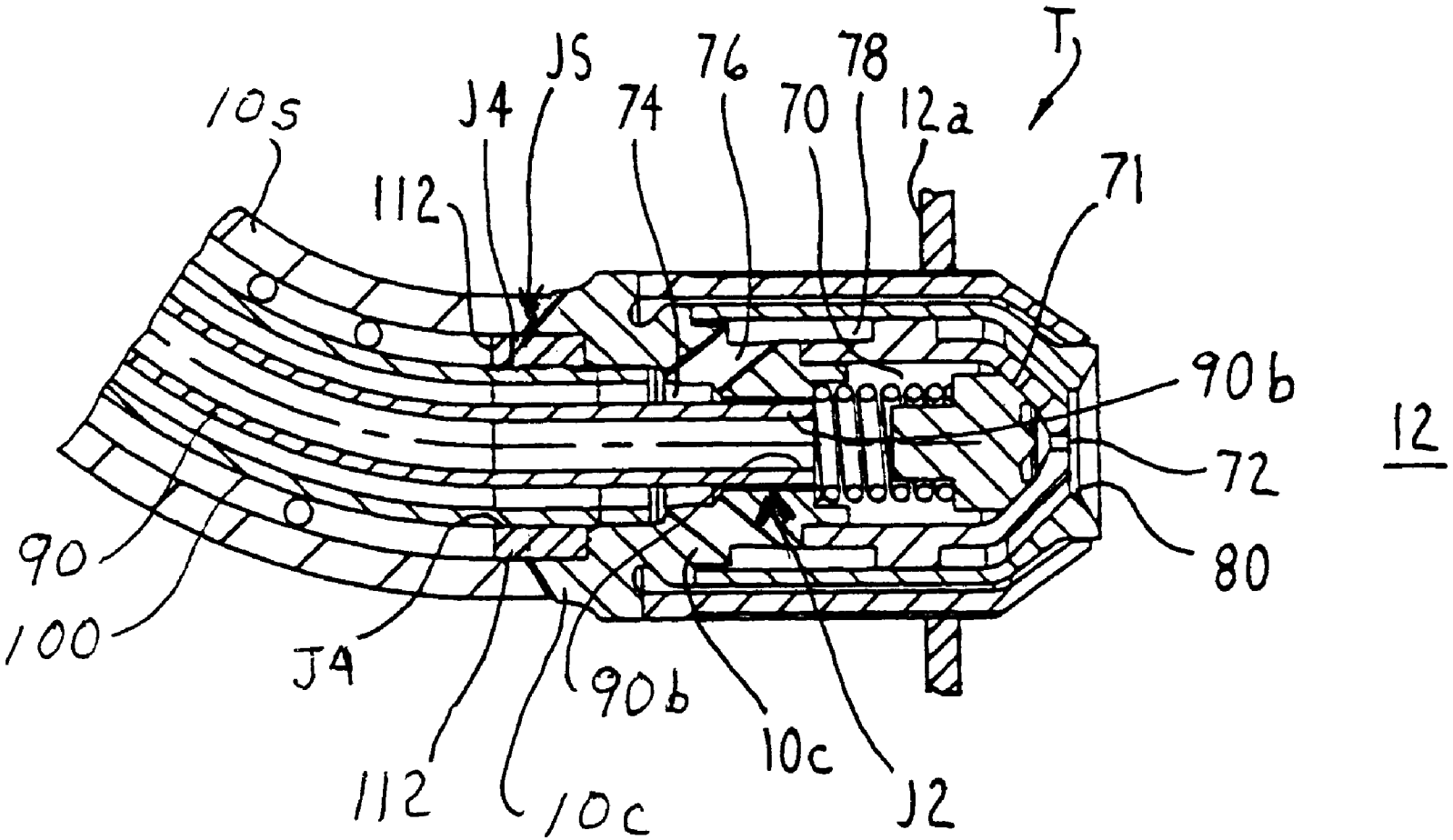
FIG. 1B is an enlarged cross-sectional view of the injector tip.

The fuel injector is shown in FIGS. 1, 1A and 1B including the injector housing 10 having an inlet fitting 22 that is supplied with pressurized fuel from a fuel manifold 25 and fuel pump (not shown) in conventional manner. A plurality of fuel injectors identical to injector 5 can be arranged about the combustor 12 and can be supplied with pressurized fuel from the manifold 25 in similar manner.

The inlet fitting 22 is communicated to an injector housing chamber 30 by passage 32. Disposed in the chamber 30 are a fuel check valve 33 and fuel metering valve 34 for controlling secondary fuel flow. The check valve 33 is biased by coil spring 35 such that head 33*a* of the check valve 33 is opened against spring bias relative to check valve seat 37 at a predetermined fuel pressure to supply pressurized fuel to primary fuel chamber 31 via one or more passages 31*a*. Passage 31*a* is provided in a valve support member 36 defining a secondary fuel chamber therein, FIG. 1A. The fuel chamber 31 communicates via passages 31*b*, 31*c* to open end 90*a* of an elongated primary fuel tube 90 to supply fuel thereto whenever the check valve 33 is open. A fuel tight plug P is disposed in passage 31*c*. The primary fuel tube 90 supplies the primary fuel flow from the open check valve 33 to central nozzle passage 70 and oblique nozzle passages 71 (one shown) to a central primary fuel discharge orifice 72 of the nozzle tip T for discharge as an atomized primary fuel spray cone into the combustor 12, FIG. 1B.

The metering valve 34 is disposed in the tubular valve support member 36. The valve support member 36 includes an end that is biased against check valve seat 37 and an opposite end held against support cup 38 by a coil spring 42. The support cup 38 is positioned in chamber 31 by braze joint JT. The coil spring 42 engages a flange of a perforated fuel filter screen or sleeve 44 against the check valve seat 37. In effect, the spring 42 holds the check valve seat 37, valve support member 36, support cup 38, and filter screen 44 in position in the chamber 31. Fuel-tight O-ring seals 39*a*, 39*b* are provided about the check valve seat 37 and secondary metering valve seat 40. Valve support member 36 is positioned in chamber 31 by braze joint JT.

The secondary metering valve 34 is biased relative to valve seat 40 by a coil spring 50 held in position on the stem of the secondary metering valve by spring retainer cap 51. Fuel in the valve support member 36 flows to the secondary valve head 34*a* via passages (e.g. 6 passages-not shown) in valve seat 40. The secondary valve 34 is held closed by spring 50 until fuel pressure reaches a preselected valve opening pressure. Then, the secondary fuel flow is metered to a chamber 52 by opening of the secondary valve 34 relative to the valve seat 40.

The chamber 52 communicates to open end 10*a* of elongated secondary fuel tube 100 to supply metered secondary fuel flow to an annular secondary fuel passage 101 defined between the primary fuel tube 90 and the secondary fuel tube 100. The secondary fuel passage 101 supplies metered secondary fuel to the annular passage 74 that communicates to oblique passages 76 and annular passage 78 of the nozzle tip T to supply the secondary fuel to annular secondary fuel discharge orifice 80 for discharge as an atomized secondary fuel spray cone into the combustor 12, FIG. 1B. As shown in FIGS. 1 and 2, the intermediate length 90L of the primary fuel tube 90 resides within the secondary fuel tube 100 in a strut portion 10*s* of the injector housing 10 such that secondary fuel flowing through the secondary fuel passage 101 during high power engine operation regimes exerts a cooling effect on the primary fuel tube 90. The secondary fuel tube 100 is spaced from the inner wall of the injector housing strut 10*s* by a Type 300 series austenitic stainless steel coil spacer spring 110 to provide a thermally insulating space between the housing strut portion 10*s* and the secondary fuel tube 100.

The end 90*a* of the primary fuel tube 90 extends beyond the secondary fuel tube 100 and is metallurgically joined to the injector housing 10. In particular, a region of the primary fuel tube 90 proximate the end 90*a* is brazed to the housing 10 to provide an annular braze joint J1 therebetween. The other opposite end 90*b* of the primary fuel tube 90 also extends beyond the secondary fuel tube 100 and is metallurgically joined to an injector nozzle tip adapter 10*c* to provide an annular braze joint J2 therebetween. The nozzle tip adapter 10*c* is welded to the end of the strut portion 10*s* at weld joint JS.

The primary fuel tube 90 typically comprises Hastelloy X alloy brazed at end 90*a* to the injector housing 10 also comprising Hastelloy X alloy using a gold/nickel (AM4787) braze material. The end 90*b* of the primary fuel tube 90 is brazed to the injector nozzle tip adapter 10*c* using the same braze material as described above. The end 100*a* of the secondary fuel tube 100 is metallurgically joined to the support cup 38. In particular, a region of the secondary fuel tube 100 proximate the end 100*a* is brazed to the support cup 38 to provide an annular braze joint J3 therebetween. The other opposite end 100*b* of the secondary fuel tube 100 is metallurgically joined to annular end sleeve 112 to provide tack welded joint 34 therebetween. The sleeve 112 is free to slide relative to the housing strut portion 10*s*.

FIG. 2 illustrates the primary fuel tube 90 disposed within the secondary fuel tube 100 before assembly in the injector housing 10. The primary fuel tube 90 is shown including a generally helical spiral 90*c* along its intermediate length between the ends 90*a*, 90*b* thereof with the spiral outer surface or wall engaging the inner surface or wall 100*c* of the secondary fuel tube in line-to-line interference contact at one or more locations L therebetween. The line-to-line interference engagement between the primary and secondary fuel tubes 90, 100 is effected by selecting the outer diameter OD of the spiral 90*c* of the primary tube (outer diameter relative to centerline of the secondary tube 100 in FIG. 2) and the inner diameter of the secondary fuel tube accordingly. For example only, the outer diameter OD of the spiral 90*c* primary fuel tube 90 can be 0.155 inch, while the inner diameter of the secondary fuel tube 100 can be 0.155 inch to this end. The non-secondary outer diameter of the primary fuel tube 90 can be 0.100 inch for the outer diameter OD of spiral 90*c* set forth.

Figure 4:
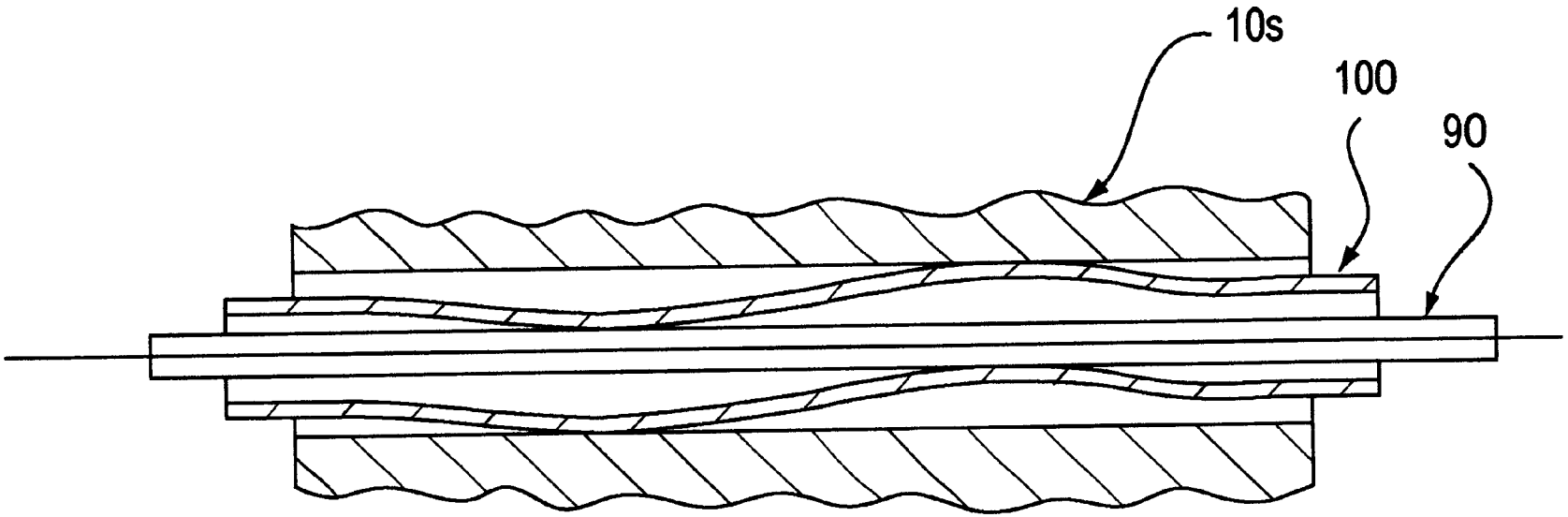
FIG. 4 is a sectional view of a primary fuel tube received in spiraled secondary fuel tube, both tubes in partially broken away strut of the fuel injector housing prior to bending of the strut.

In an alternative embodiment of the invention, the secondary fuel tube 100 can include a generally helical spiral, while the primary fuel tube 90 can be straight. In this embodiment, the secondary fuel tube 100 would include a generally helical spiral along its intermediate length between the tube ends with the spiral inner surface or wall engaging the outer surface or wall of the primary fuel tube 90, FIG. 4. The spiral outer surface of the secondary fuel tube 100 also can engage the wall of passage 10*p* of the strut portion 10*s* in line-to-line interference contact, whereby the inner surface of the secondary tube spiral engages the primary fuel tube 90 while the outer surface of the secondary tube spiral engages the wall defining the passage 10*p*. The spacer spring 110 thereby can be omitted in this embodiment to simplify construction, FIG. 4, which shows tubes 90, 100 in strut portion 10*s* prior to bending thereof to shape of FIG. 1.

The spiral 90*c* preferably comprises one complete helical turn having a pitch of 3.27 inches for example only, although 1½ to 2 spiral turns or more and other spiral pitch may be used in practicing the invention depending upon the particular design of the fuel injector and primary and secondary fuel tubes. The length of the spiral 90*c* is selected to provide interference engagement along a sufficient portions or locations of the intermediate lengths of the primary and secondary fuel tubes 90, 100 effective to reduce or essentially eliminate heretofore observed fatigue failure at the brazed joints J1, J2 during service in a gas turbine engine and to permit increased axial compliance (decreased stress under a given axial deflection) of the primary tube 90 during thermal expansion of the injector support housing to thereby lower thermally induced internal stresses imparted by a given thermal strain caused by rigid attachment of the relatively cool primary tube 90 to the relatively hot support housing 10 and increasing fatigue life.

Figure 3:
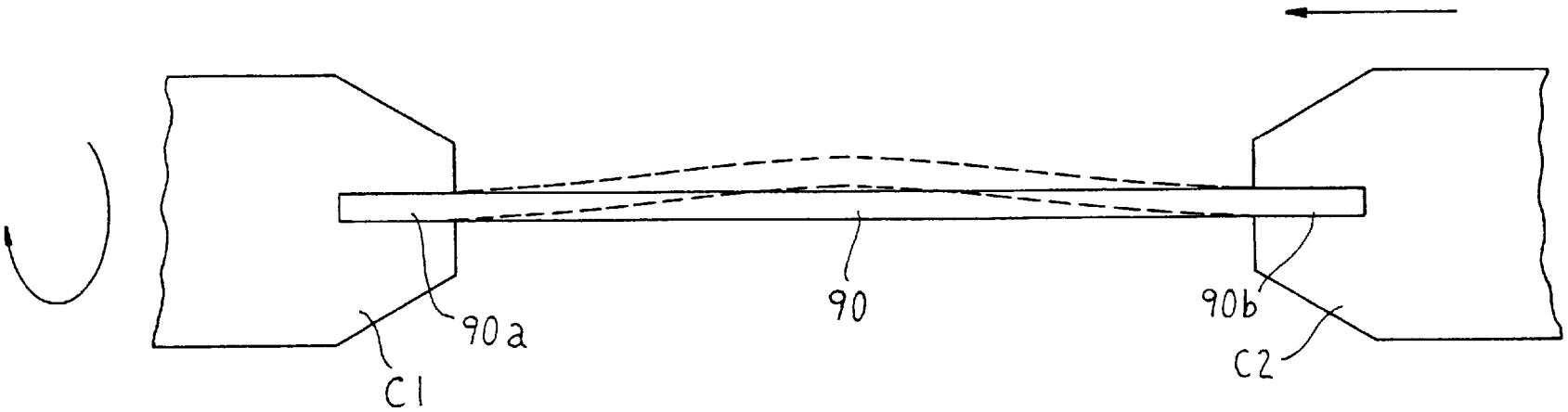
FIG. 3 is a schematic view of the apparatus for imparting a helical spiral to the primary fuel tube.

In practicing the invention, the primary fuel tube 90 can be imparted with the spiral 90*c* in a manner illustrated schematically in FIG. 3. In particular, the opposite ends 90*a*, 90*b* of the primary fuel tube are clamped in collet chucks or clamps C1, C2 of a conventional lathe (not shown). The primary fuel tube 90 so fixtured in the collet clamps C1, C2 then is bowed to an arcuate profile shown in dashed lines from its original straight tube profile. Bowing is effected by tube buckling to an extent to provide the aforementioned outer diameter OD of the spiral 90*c*. Then, the bowed primary fuel tube 90 is deformed by rotating one of the clamps C1, C2, or both, a selected angular extent to form the spiral 90*c* with the turn(s) and helical pitch desired. For example, one of the collet clamps C1, C2 is rotated somewhat greater than 360 degrees relative to the other to form a one turn helical spiral in the bowed primary fuel tube 90. Pitch of the helix is determined by the degree of bowing and the buckled tube length between the collet clamps.

After spiral formation, the primary fuel tube 90 is removed from the lathe, cleaned, and then inserted in the secondary fuel tube 100 as shown in FIG. 2 to provide the aforementioned line-to-line interference engagement along sufficient portions or locations of the intermediate lengths of the primary and secondary fuel tubes 90, 100 effective to reduce brazed joint fatigue failure during service in a gas turbine engine. For purposes of illustration only, a primary fuel tube 90 having an as-received straight outer diameter of 0.100 inch can be spiraled in the manner described above and tested for proper spiral outer diameter OD by inserting the spiralled primary fuel tube 90 first in a straight gaging tube (not shown) having an inner diameter of 0.160 inch and then in a second gaging tube (not shown) having an inner diameter of 0.150 inch. The spiraled primary fuel tube 90 must pass through the first gaging tube but not the second gaging tube.

The subassembly 120 of the spiraled primary fuel tube 90 in the secondary fuel tube 100 is inserted in the injector housing 10 prior to bending (deforming) of the strut portion 10*s* to its compound arcuate configuration shown in FIG. 1. The coil spring 110 is positioned about the secondary fuel tube 100. The primary and secondary fuel tubes 90, 100 and their associated components (e.g. strut end 10*c*, support cup 38, end sleeve 112, etc.) then are brazed or welded using conventional brazing/welding procedures. Subsequent bending of the strut portion 10*s* to its compound arcuate shape imparts the arcuate configuration shown in FIG. 1 to the subassembly 120 of the primary and secondary fuel tubes 90, 100. After bending, the primary fuel tube 90 retains its spiral 90*c* that remains in line-to-line interference engagement, FIG. 1, along sufficient portions or locations of the intermediate lengths with the inner wall of secondary fuel tube 100 effective to essentially eliminate heretofore observed fatigue failure at the brazed joints J1, J2.

After the injector housing has been bent and machined to final envelope dimensions, the components of check valve 33, metering valve 34 and nozzle tip T are assembled to complete the fuel injector 5.

Tests of the fuel injector 5 described above have been conducted under simulated gas turbine engine conditions of $3\times10^7$ vibration cycles at greatest tip response resonance frequency with 12*g* forced sinusoidal input at the injector flange 11 in three mutually perpendicular planes (axial, radial and tangential relative to the gas turbine engine axis). Additional separate thermal cycling tests have been conducted using 10,000 thermal shock cycles on the primary fuel tube where a cycle involves maintaining the nozzle strut 10*s* and tip T at a temperature of greater than 950 degrees F, introducing room temperature water through the fuel passages for 0.16 seconds and terminating water flow for one minute, and then repeating the cycle. The fuel injector 5 did not exhibit fatigue failure at brazed joints J1, J2 in any of these simulated engine tests.

While the invention has been described in terms of specific embodiments thereof, it is not intended to be limited thereto but rather only to the extent set forth in the following claims.

I claim:

1. A fuel injector for a gas turbine engine, comprising:

a fuel injector housing, and an elongated fuel tube held in position in said housing by spaced apart joints and including a spiral tube surface along at least a portion of its length between said joints, said spiral tube surface being in contact with another surface disposed in said housing at one or more locations of said spiral tube surface.

2. The injector of claim 1 wherein opposite end regions of said fuel tube are held in position by said joints and said spiral tube surface extends from one of said end regions to the other of said end regions.

3. The injector of claim 2 wherein opposite end regions of said fuel tube comprise brazed joints.

4. The injector of claim 1 wherein said another surface comprises an inner surface of a second fuel tube disposed about said fuel tube in said housing.

5. The injector of claim 1 wherein said another surface comprises an outer surface of a second fuel tube disposed inside said fuel tube in said housing.

6. The injector of claim 1 wherein said another surface defines a passage in an injector strut.

7. A fuel injector for a gas turbine engine, comprising:

a fuel injector housing having an internal passage therein, an elongated secondary fuel tube disposed in said internal passage and having an internal wall, and an elongated primary fuel tube disposed in said secondary fuel tube and held in position therein by spaced apart joints, said primary fuel tube including a spiral outer surface along at least a portion of its length between said joints, said spiral outer surface being in contact with said internal wall at one or more locations of said spiral outer surface to reduce fatigue failure at said joints during service in a gas turbine engine.

8. Assembly for a fuel injector, comprising an elongated first fuel tube and an elongated second fuel tube disposed in said first fuel tube, one of said first fuel tube and second fuel tube including a spiral surface along at least a portion of its length, said spiral surface being in contact between said first fuel tube and second fuel tube at one or more locations of said spiral surface.

9. The assembly of claim 8 wherein said first fuel tube includes said spiral surface.

10. The assembly of claim 8 wherein said second fuel tube includes said spiral surface.

* * * * *